United States Patent [19]

Kanazawa et al.

[11] Patent Number: 4,708,047

[45] Date of Patent: Nov. 24, 1987

[54] PAD CUPS FOR A WOOD WIND

[75] Inventors: Kyoetsu Kanazawa; Mitsuo Ono, both of Shizuoka, Japan

[73] Assignee: Nippon Gakki Seizo Kabushiki Kaisha, Japan

[21] Appl. No.: 854,040

[22] Filed: Apr. 21, 1986

[30] Foreign Application Priority Data

Apr. 24, 1985 [JP] Japan ..... 60-060191[U]

[51] Int. Cl.[4] ..... G10D 9/04

[52] U.S. Cl. ..... 84/385 P

[58] Field of Search ..... 84/385 P

[56] References Cited

U.S. PATENT DOCUMENTS

| | | | |
|---|---|---|---|
| 1,681,220 | 8/1928 | Ciccone | 84/385 P |
| 2,728,256 | 12/1955 | Melcher | 84/385 P |
| 4,158,979 | 6/1979 | Suzuki | 84/385 P |

*Primary Examiner*—Lawrence R. Franklin

*Attorney, Agent, or Firm*—Ostrolenk, Faber, Gerb & Soffen

[57] ABSTRACT

In construction of a pad for a pad cup of a woodwind, the outermost skin bag is internally provided, at least in the region where the pad cup contacts an associated sound hole in the woodwind, with an air impervious layer such as a bladder sheet to ensure that the sound hole will be closed with a high degree of airtightness and which will ensure that the desired pad configuration is maintained over a long period of time.

9 Claims, 3 Drawing Figures

PAD CUPS FOR A WOOD WIND

BACKGROUND OF THE INVENTION

1. Field of the Invention

The present invention relates to an improved pad cup for a woodwind instrument, and more particularly relates to an improvement in an airtight closure formed by a pad cup and a sound hole in a wood-wind such as a clarinet or a saxophone.

Conventionally, a pad cup is held by a key rod which rotates axially when a key associated with the pad cup is manually operated. The cup has a cylindrical shape which is closed at one end and which accommodates a pad. The pad includes, from the closed end to the open end of the cup: a substrate made of high quality paper, a sheet made of felt, and a bag made of either animal skin or bladder covering the substrate and the sheet. The pad cup is mounted to the woodwind in an arrangement such that the pad faces the associated sound hole in the woodwind and that, when the associated key is manually operated, the pad closes the sound hole. This closure by the pad requires a high degree of airtightness in order to avoid any changes in tonal pitch, tone volume and tone color when the woodwind is played.

Bags made of animal skin are highly durable but have many pores. Such pores cause air leaks thereby preventing the sound hole from being closed with a high degree of airtightness. This causes an unstable performance of the woodwind and a poor rise of sounds. When a bladder bag is used, the pad can close the sound hole with a high degree of airtightness but the endurance of the bladder bag is poor compared to that of a skin bag. Thus, in the conventional art, endurance of a pad cup is not compatible with a highly airtight closure of sound holes.

SUMMARY OF THE INVENTION

It is the object of the present invention to provide a pad cup for a woodwind which exhibits both a high degree of airtightness and is highly durable.

In accordance with the basic concept of the present invention, a flexible, resilient, air impervious material is attached to a flexible, air pervious core on the side of the sound hole and the core and the air impervious material are covered by animal skin to form a pad for closure of sound holes.

DESCRIPTION OF THE PREFERRED EMBODIMENTS

Figure 1:
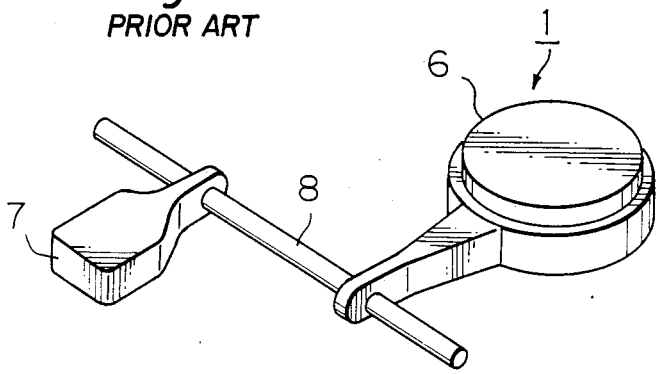
Fig. 1 PRIOR ART
FIG. 1 is a perspective view of a conventional pad cup arrangement.

As shown in FIG. 1, a conventional pad cup arrangement includes a pad cup 1 coupled to a key 7 via a key rod 8. As the key 7 is manually operated, axial rotation of the key rod 8 drives the pad cup 1 for a desired action.

Figure 2:
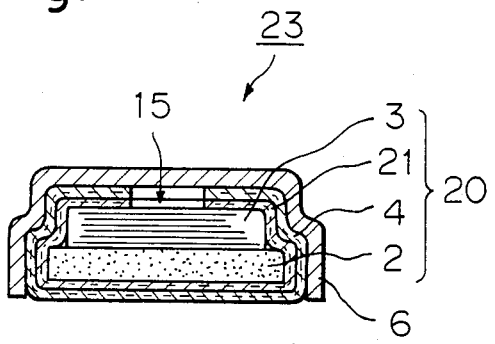
FIG. 2 is a sectional side view of one embodiment of the pad cup in accordance with the present invention.

One embodiment of the pad cup 23 in accordance with the present invention has a construction shown in FIG. 2, in which a cup 6 houses a pad 20 including a core 15, an inner bag 21 made of bladder and covering the core 15, and an outer bag 4 made of animal skin. The pad 20 is bonded to the interior of cup 6 which has a conventional configuration. One possible construction of the core 15 includes a paper substrate 3 and a felt sheet 2 bonded to each other in superimposition.

With this construction, the outer skin bag 4 provides a rich endurance and protects the inner bladder bag 21 which exhibits a poor endurance. Further, when the pad 20 closes a sound hole, the outer skin bag 4 comes in direct contact with the mouth of the sound hole. The highly air impervious inner bladder bag 21 stops air leaks through pores in the outer skin bag 4.

In accordance with the present invention, the rich endurance exhibited by animal skin is combined with the high degree of air imperviousness exhibited by the bladder in order to close sound holes in a woodwind with a high degree of airtightness. In particular, the high degree of airtightness exhibited by the bladder produces soft sounds with good response. The use of skin maintains the desired configuration of the entire pad due to its rich endurance, thereby assuring a stabilized performance. When combined with a highly airtight bladder, even animal skins with many pores may satisfactorily be used for the outer bag of the pad.

Air leaks only occur at the section of the outer skin bag 4 where the bag 4 contacts the mouth of the sound hole. For this reason, it is not necessary to totally cover the core 15 with the inner blade bag 21. The bladder may take the form of a sheet which is coextensive with the felt sheet 2 and which is interposed between the felt sheet 2 and the outer skin bag 4.

Figure 3:
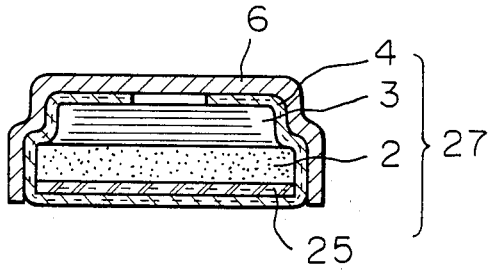
FIG. 3 is a sectional side view of another embodiment of the pad cup in accordance with the present invention.

Another embodiment of the pad cup in accordance with the present invention is shown in FIG. 3, in which a plastic film 25 is used. More specifically, a pad 27 includes a paper substrate 3, a felt sheet 2, the plastic film 25 and a bag 4 made of the animal skin. The high degree of airtightness exhibited by the plastic film 25 stops air leaks through pores in the skin bag 4.

When bladder is used for airtightness, its thickness should preferably be about 0.2 mm. When plastic is used for airtightness, its thickness should preferably be about 1mm or less. Nylon may preferably be used. Thickness of the skin bag should preferably be 1 mm or less.

In order to increase the air imperviousness of the skin bag 4, the inner face of the skin bag 4 contacting the bladder bag 21 or the plastic film 25 may be impregnated with thermo-setting and thermoplastic resins. To this end, thermo-setting resins such as amino resin, triazone, urone, propylene urea and ethylene urea are suitable. Thermoplastic resins such as vinyl acetate, acrylic ester, polyethylene and polyacrylamide are also suitable.

We claim:

1. An improved pad cup for a wood wind, comprising:

a cup having an open end; and a pad located in said cup, said pad including: a flexible, air pervious core; a flexible, resilient, air impervious layer covering said core in the area of said open end of said cup; and a skin bag covering both said core and said air impervious layer.

2. An improved pad cup as claimed in claim 1 in which said air impervious layer is a bladder bag accommodating said core.

3. An improved pad cup as claimed in claim 1, in which said air impervious layer is a bladder sheet which is coextensive with said core.

4. An improved pad cup as claimed in claim 1, in which said air impervious layer is flexible, resilient plastic film.

5. An improved pad cup as claimed in claim 1, in which said air impervious layer includes resin impregnated in the inner surface of said skin bag.

6. An improved pad cup as claimed in claim 5, in which said resin is thermo-setting resin.

7. An improved pad cup as claimed in claim 5, in which said resin is thermo-plastic resin.

8. An improved pad cup as claimed in claim 1, wherein said air impervious layer covers said core across the entire area of said open end of said cup.

9. An improved pad cup for wood wind as claimed in claim 1, further including a key coupled to said cup via a key rod.

* * * * *